US011028568B1

(12) United States Patent
Adamek et al.

(10) Patent No.: US 11,028,568 B1
(45) Date of Patent: Jun. 8, 2021

(54) DETENTION POND METHOD

(71) Applicants: Frank Charles Adamek, Spring, TX (US); Benton Frederick Baugh, Houston, TX (US)

(72) Inventors: Frank Charles Adamek, Spring, TX (US); Benton Frederick Baugh, Houston, TX (US)

( * ) Notice: Subject to any disclaimer, the term of this patent is extended or adjusted under 35 U.S.C. 154(b) by 0 days.

(21) Appl. No.: 16/825,306

(22) Filed: Mar. 20, 2020

(51) Int. Cl.
*E03F 1/00* (2006.01)
*E02B 3/02* (2006.01)
*E03F 5/10* (2006.01)

(52) U.S. Cl.
CPC ..... *E03F 1/001* (2013.01); *E03F 5/103* (2013.01); *E03F 5/107* (2013.01); *E02B 3/02* (2013.01)

(58) Field of Classification Search
CPC ..... E02B 3/00; E02B 3/02; E03F 1/001
USPC ..... 405/52, 53
See application file for complete search history.

(56) References Cited

U.S. PATENT DOCUMENTS 4,919,568 A * 4/1990 Hurley ..... E02B 11/00 405/43
5,160,216 A * 11/1992 Takada ..... E02B 3/00 137/386
5,228,802 A * 7/1993 Kuwabara ..... E02B 11/00 405/36
5,360,290 A * 11/1994 Yamada ..... F04D 29/448 405/52
5,752,785 A * 5/1998 Tanaka ..... E03F 5/22 405/52
5,909,982 A * 6/1999 Takada ..... E03F 5/22 405/52
6,000,880 A * 12/1999 Halus ..... E03B 1/00 405/52
7,419,334 B2 9/2008 Baugh
7,866,919 B2 * 1/2011 Miller ..... E02B 9/02 405/80
9,309,989 B1 * 4/2016 Lang ..... E03F 5/105
10,213,815 B1 2/2019 Baugh
2017/0089056 A1 * 3/2017 Schafer ..... E02B 7/26

FOREIGN PATENT DOCUMENTS

AU 2010227080 * 4/2011
CN 102493391 A * 6/2012
CN 107386196 A * 11/2017
CN 107956214 A * 4/2018
FR 2871176 A1 * 12/2005 ..... E02B 3/02
GB 2379236 A * 3/2003 ..... E02B 3/02
KR 20140096252 A * 8/2014
KR 101484891 B1 * 1/2015
WO WO-2013152753 A1 * 10/2013 ..... E02B 3/02

* cited by examiner

*Primary Examiner* — Frederick L Lagman

(57) ABSTRACT

A detention pond for the passive temporary storage of detained water during a potential flooding event near a river, stream or bayou where the depth and therefore the volume of the detention pond is not set by the elevation of the normally flowing water in said river, stream or bayou adjacent detention pond but rather the drain line connects to the river, stream or bayou downstream of the detention pond where the elevation is at a lower level, allowing the detention pond to be dug deeper and therefore of proportionately greater volume.

20 Claims, 3 Drawing Sheets

DETENTION POND METHOD

TECHNICAL FIELD

This invention relates to the method of minimizing flooding by the use of detention ponds.

BACKGROUND OF THE INVENTION

A detention pond is an area excavated near river, steam stream, or bayous to protect against areas flooding, generally in urban areas. Detention ponds receive potentially flooding waters and hold it for release at a predetermined rate. Detention ponds are designed to release all captured runoff over time, and do not allow for permanent pooling of water. This is generally done with a simple pipe connecting the bottom of the detention pond to the river, stream, or bayou or in other words with a drain-pipe.

The depth of the detention pond is set by the elevation of the water in the river, stream, or bayou during normal flow or the average flow during a non-flooding event. Water typically enters a detention pond when the river, stream, or bayou is reaching or near flood stage and simply flows over a weir to fill the detention pond.

The volume of the detention pond is a function the surface area of how much expensive real estate you buy times the depth of the detention pond. This land is called "expensive" as a detention pond would only be constructed in a developed area which you want to protect, and developed land is expensive.

Detention ponds are frequently used in slightly sloping urban areas with the U.S. Gulf Coast and Houston, Tex. in particular being an example. With the volume of rainfall in Houston and the low grade to the slope, many areas are subject to flooding, and have been since urbanization happened in the $19^{th}$ century (if not before). Increasing the channel size and detention ponds have been tried for many years with the present result being that the existing detention ponds are over-run with flood waters in a heavy rain. The resulting use of conventional detention ponds has not solved the problem and massive flooding damage continues to happen in Houston.

BRIEF SUMMARY OF THE INVENTION

The object of this invention is to provide a greater detention pond capacity without having to buy more real estate.

A second object of this invention is to utilize the natural slope of the geographic area to increase the depth of a detention pond and thereby increase the capacity of the detention pond.

A third objective of this invention is to interconnect the drain-pipes of detention ponds to provide a greater detention pond capacity.

Another objective of this invention is to allow detention ponds to be utilized for other purposes when flooding is not expected.

DETAILED DESCRIPTION OF THE INVENTION

Figure 1:
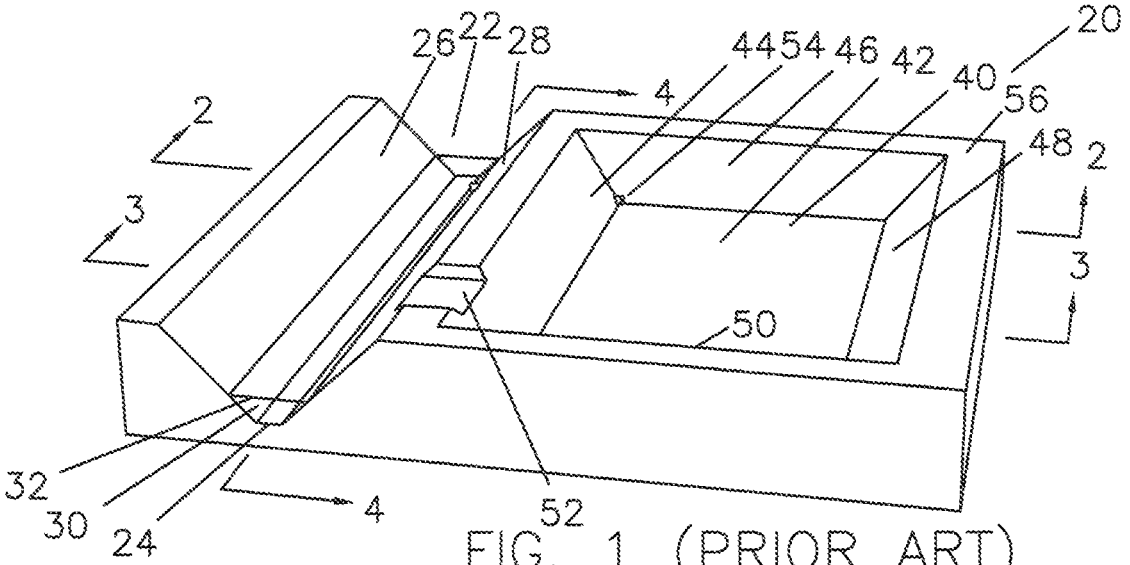
FIG. 1 (PRIOR ART)
FIG. 1 is a perspective view of the general area of a detention pond.

FIG. 1 is a perspective view of a detention pond area 20 showing a river, stream, or bayou 22 having a bottom 24, sides 26 and 28, and water 30 flowing in the river, stream, or bayou. The water flowing in the river, stream, or bayou is of an elevation 32 in this figure. The detention pond 40 has a bottom 42, sides 44, 46, 48, and 50 (not seen), a weir 52 to direct near flooding waters to be detained into the detention pond 40 and a drain-pipe 54 to slowly release the detained waters back into the river, stream, or bayou 22. Ground level 56 is shown around the river, stream, or bayou and detention pond.

Figure 2:
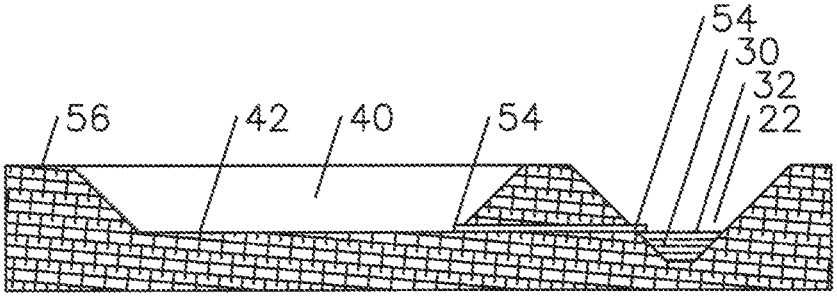
FIG. 2 (PRIOR ART)
FIG. 2 is taken along lines "2-2" of FIG. 1 and shows a section through the drain-pipe.

Referring now to FIG. 2 taken along lines "2-2" of FIG. 1, drain-pipe 54 is shown to connect the bottom 42 of the detention pond 40 with the river, stream, or bayou 22 above the elevation 32 of the waters 30 during the normal flow of the river, stream, or bayou.

Figure 3:
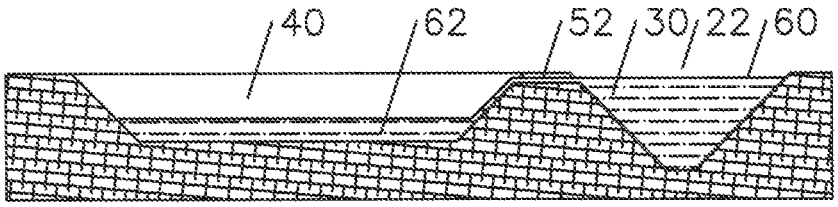
FIG. 3 (PRIOR ART)
FIG. 3 is taken along lines "3-3" of FIG. 1 and shows a section through the weir and flooding waters entering the detention pond.

Referring now to FIG. 3 taken along lines "3-3" of FIG. 1, the elevation 60 of the water 30 in the river, stream, or bayou 22 is at flood stage and a portion of the water 62 is following across the weir 52 into the detention pond 40

Figure 4:
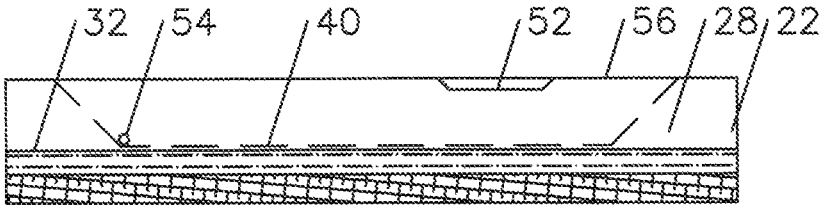
FIG. 4 (PRIOR ART)
FIG. 4 is taken along lines "4-4" of FIG. 1 looking from the river, stream, or bayou and shows the weir inlet to the detention pond and the drain-pipe outlet from the detention pond.

Referring now to FIG. 4 taken along lines "4-4" of FIG. 1 from within the river, stream, or bayou 22 showing the weir 52 being relatively high on the river, stream, or bayou bank and the drain-pipe 54 being relatively low but above the normal flowing level 32 of the river, stream, or bayou 22. It should be noted here that the perception is that the detention pond 48, river, stream, or bayou 22, and the ground level 56 are generally perceived as being level.

Figure 5:
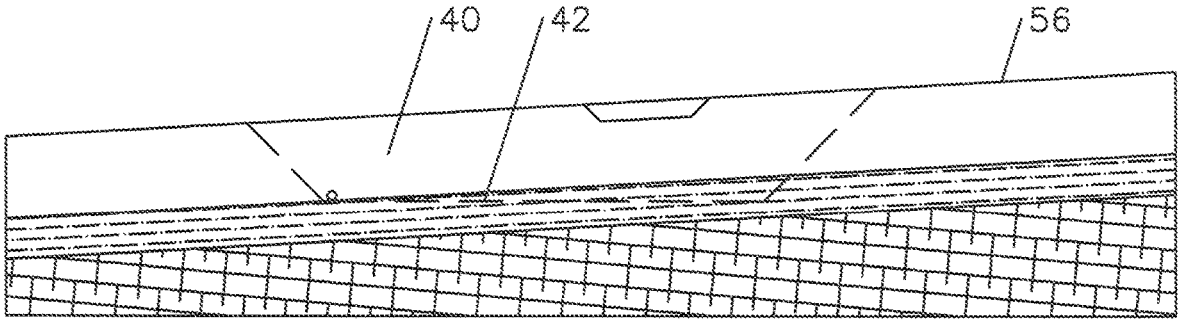
FIG. 5 (PRIOR ART)
FIG. 5 is taken along lines "4-4" of FIG. 1 and is the same view a FIG. 4 except showing an exaggerated slope in the ground level.

Referring now to FIG. 5 taken along lines "4-4" of FIG. 1 and is the same view a FIG. 4 except showing a slope in the ground level elevation 56. Although the slope is exaggerated for understanding, the slope always exists or the river, stream, or bayous would not flow. The bottom 42 of the detention pond 40 is shown level as within the relatively small area of the detention pond. It will likely be constructed flat.

Figure 6:
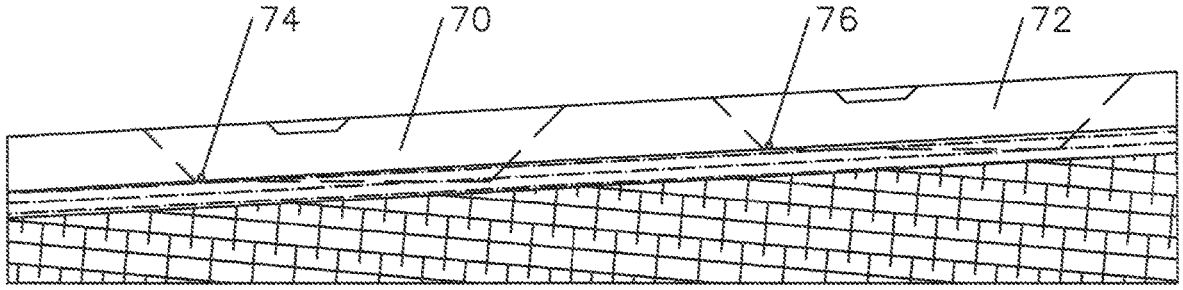
FIG. 6 (PRIOR ART)
FIG. 6 a similar view to what was shown in FIG. 5, but the scale reduced some to show two detention ponds along a river, stream, or bayou.

Referring now to FIG. 6 a similar view to what was shown in FIG. 5 is shown, but the scale reduced some to show two detention ponds 70 and 72 along river, stream, or bayou 22. They are shown as being identical to show the two drain-pipes 74 and 76 being at different elevations. This is how two detention ponds would be constructed without the benefits of the present invention.

Figure 7:
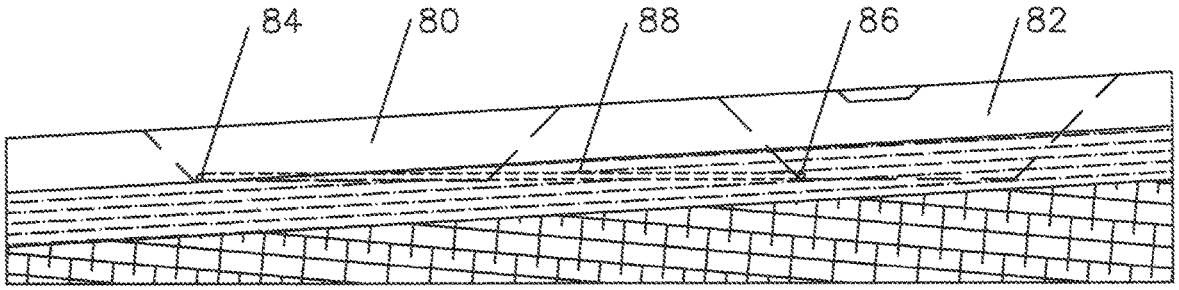
FIG. 7 is a similar view to FIG. 6, two detention ponds are shown with the upstream detention pond taking advantage of the capacity increase of the present invention.

Referring now to FIG. 7, detention pond 80 along river, stream, or bayou 22 is identical to detention pond 70 in FIG. 6, however, the elevation of drain-pipe 86 in detention pond 82 is at the same elevation as drain-pipe 84 in detention pond 80 and is connected to drain-pipe 84 by interconnecting pipe 88. This allows detention pond 82 to be dug to the same actual elevation as detention pond 80, or in other words deeper by the amount of the geographic slope from the area of detention pond 82 to the area of detention pond 80. Consider that the depth of detention pond 80 is ten feet deep and the geographic area around detention pond 82 is five feet higher. This means that detention pond can be dug five feet deeper and therefore increase its capacity by fifty percent.

If this process were repeated further upstream, the next detention pond at a five foot higher elevation can be dug ten feet deeper to thirty feet, giving it a one hundred percent increase in capacity. Alternately the process can be repeated downstream with the only limit ultimately being the ocean level.

Figure 8:
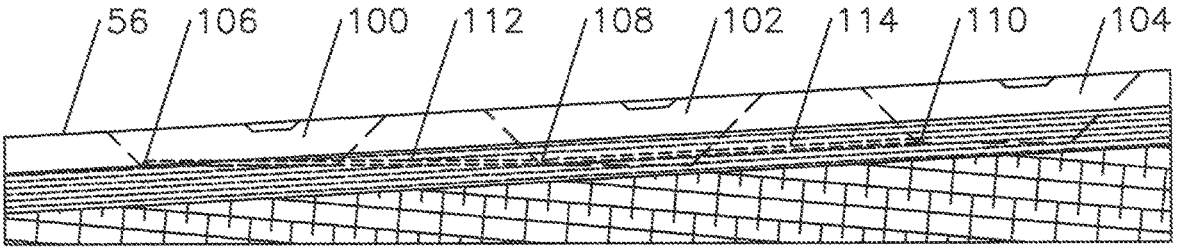
FIG. 8 is a reduced scale view of FIG. 7 showing three detention ponds with two of them taking advantage of the capacity increase of the present invention.

Referring now to FIG. 8, detention pond 100 is the same as detention pond 80, 70, and 40 in FIGS. 7, 6, and 5 respectively. Detention ponds 102 and 104 are the same as the deeper detention pond 82 in FIG. 7. Drain-pipes 106, 108, and 110 are in detention ponds 100, 102, and 104 respectively. Interconnecting pipe 112 connects drain-pipes 106 and 108 similarly as interconnecting pipe 88 connected drain-pipes 84 and 86 in FIG. 7 and is similarly approximately level or at a slight slope. Interconnecting pipe 114 connects drain-pipes 108 and 110, but is at approximately the same slope as the ground level 56 as detention ponds 102 and 104 have effectively the same depth.

The drawings presume that the most downstream detention pond will be of the shallower depth of a detention pond without the benefits of the present invention. There is, however, no need for having a detention pond of the shallower depth of a detention pond without the benefits of this invention. All detention ponds can take advantage of the greater depth by having their drain-pipe being diverted to a more downstream location of a lower elevation.

Given that detention ponds are a solution to urban flooding and urban property is both expensive and has restricted availability, this method provides a solution to both having to buy more expensive property to detain water and where to buy the property by giving any detention a greater capacity.

Figure 9:
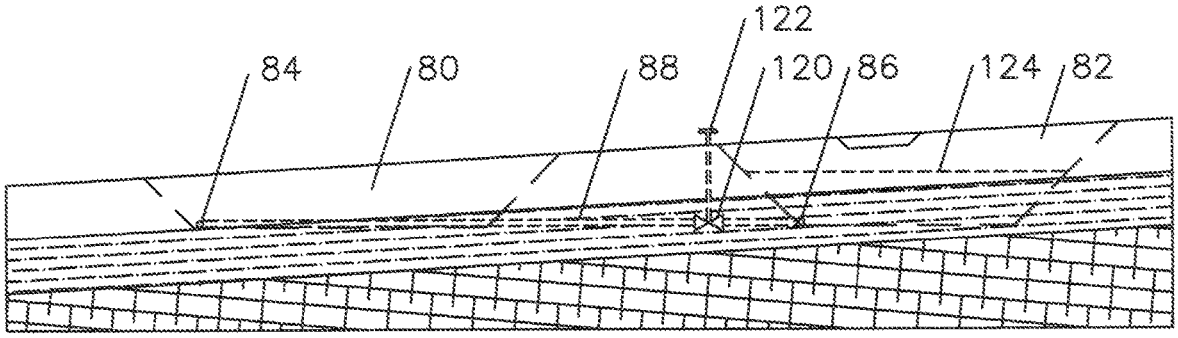
FIG. 9 is a similar view to FIG. 7, with a valve added in the drain-pipe to allow water to be retained within the detention pond for recreational or other purposes in non-rainy seasons.

Referring now to FIG. 9 which is similar to FIG. 7, valve 120 is shown in interconnecting pipe 88 which can be closed in seasons or times in which flooding is not expected. When valve is closed with a manual or powered actuator 122, detention pond 82 can be partially or fully filled with water such as to level 124 and used for other purposes such as recreation or fire prevention. In most cases flooding and fires tend to happen at different times of the year, so multiple uses can be made of capital resources such as detention ponds.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below.

SEQUENCE LISTING

N/A

That which is claimed is:

1. A method of using a detention pond which will completely drain during non-flooding times to minimize flooding during a flooding event, comprising providing a detention pond, digging said detention pond to a deeper elevation than an elevation of a normal flowing level of an adjacent portion of a river, stream, or bayou proximate said detention pond, connecting a first end of a drain pipe to a bottom of said detention pond, and connecting a second end of said drain pipe to said river, stream, or bayou at a downstream location where the normal flowing elevation of said river, stream, or bayou is lower than the normal flowing elevation of said river, stream, or bayou proximate said detention pond, such that said detention pond will completely drain during non-flooding times and therefore have a greater water storage capacity for a given surface area of real estate that a detention pond dug to the normal flowing elevation of the river, stream, or bayou proximate said detention pond.

2. The method of claim 1 wherein said downstream location on said river, stream, or bayou is the location of a second detention pond.

3. The method of claim 1 wherein three or more detention ponds are interconnected.

4. The method of claim 1 further comprising adding a valve to said drain pipe to allow water to be stored in said detention pond at times when flooding is not a consideration.

5. The method of claim 4 further comprising said valve is manually actuated.

6. The method of claim 4 further comprising said valve is equipped with a power actuator such as electric, hydraulic, or pneumatic.

7. The method of claim 4 further comprising said valve is adjustable to regulate the rate of flow from said detention pond back into said river, stream, or bayou.

8. The method of claim 4 further comprising said valve is a multi-position valve with at least a closed position, a high flow position, and a low flow position.

9. The method of claim 1 further comprising connecting two detention ponds with an interconnecting pipe to allow an upstream detention pond to be dug to a similar depth as a downstream detention pond.

10. A method of using a detention pond whose volume is generally a product of a surface area times a depth which will completely drain during non-flooding times to minimize flooding during a flooding event, comprising providing a detention pond, digging said detention pond to a deeper elevation than an elevation of a normal flowing level of an adjacent portion of a river, stream, or bayou proximate said detention pond, connecting a first end of a drain pipe near a bottom of said detention pond, and connecting a second end of said drain pipe to said river, stream, or bayou at a downstream location where a normal flowing elevation of said river, stream, or bayou is lower than the normal flowing elevation of said river, stream, or bayou proximate said detention pond, such that said detention pond will completely drain during non-flooding times and will have a greater water storage capacity for a given surface area of real estate than a detention pond dug to the normal flowing elevation of the river, stream, or bayou proximate said detention pond.

11. The method of claim 10 wherein said downstream location on said river, stream, or bayou is the location of a second detention pond.

12. The method of claim 10 wherein three or more detention ponds are interconnected.

13. The method of claim 10 further comprising adding a valve to said drain-pipe to allow water to be stored in said detention pond at times when flooding is not a consideration.

14. The method of claim 10 further comprising connecting two detention ponds with an interconnecting pipe to allow an upstream detention pond to be dug to a similar depth as a downstream detention pond.

15. A method of using a detention pond which will completely drain during non-flooding times to minimize flooding during a flooding event, comprising providing a detention pond near a river, stream, or bayou which has a first normal flowing water level proximate said detention pond and a lower second flowing water elevation at a downstream location, digging said detention pond to a deeper elevation than said first normal flowing water level of said river, stream, or bayou but not deeper than said lower second flowing water elevation, connecting a first end of a drain pipe to the bottom of said detention pond, and connecting a second end of said drain pipe to said river, stream, or bayou at said downstream location, such that said detention pond will completely drain during non-flooding times and therefore have a greater water storage capacity for a given surface area of real estate that a detention pond dug to said first normal flowing elevation of said river, stream, or bayou.

16. The method of claim 15 wherein said downstream location on said river, stream, or bayou is the location of a second detention pond.

17. The method of claim 15 wherein three or more detention ponds are interconnected.

18. The method of claim 15 further comprising adding a valve to said drain pipe to allow water to be stored in said detention pond at times when flooding is not a consideration.

19. The method of claim 18 further comprising said valve is a multi-position valve with at least a closed position, a high flow position, and a low flow position.

20. The method of claim 15 further comprising connecting two detention ponds with an interconnecting pipe to allow an upstream detention pond to be dug to a similar depth as a downstream detention pond.

* * * * *